US007944420B2

(12) United States Patent
Antony

(10) Patent No.: US 7,944,420 B2
(45) Date of Patent: May 17, 2011

(54) LIGHT EMITTING DIODE DRIVER PROVIDING CURRENT AND POWER CONTROL

(75) Inventor: Biju Antony, Woburn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 900 days.

(21) Appl. No.: 11/864,061

(22) Filed: Sep. 28, 2007

(65) Prior Publication Data

US 2009/0085901 A1 Apr. 2, 2009

(51) Int. Cl.
*G09G 3/32* (2006.01)

(52) U.S. Cl. ..... 345/82; 345/98

(58) Field of Classification Search ..... 345/82–102, 345/204, 212; 315/291
See application file for complete search history.

(56) References Cited

U.S. PATENT DOCUMENTS

| | | | | |
|---|---|---|---|---|
| 6,433,488 | B1 * | 8/2002 | Bu | 315/169.3 |
| 7,088,319 | B2 * | 8/2006 | Yoshida et al. | 345/82 |
| 7,236,148 | B2 * | 6/2007 | Yoshida et al. | 345/76 |
| 7,317,403 | B2 * | 1/2008 | Grootes et al. | 340/815.45 |
| 7,564,434 | B2 * | 7/2009 | Kim | 345/82 |
| 7,714,515 | B2 * | 5/2010 | Emek et al. | 315/291 |
| 7,777,704 | B2 * | 8/2010 | S et al. | 345/82 |
| 7,800,558 | B2 * | 9/2010 | Routley et al. | 345/77 |
| 7,808,451 | B1 * | 10/2010 | Rutherford | 345/45 |
| 2004/0196225 | A1 * | 10/2004 | Shimada | 345/82 |
| 2006/0022214 | A1 | 2/2006 | Morgan et al. | |
| 2006/0109205 | A1 * | 5/2006 | Deng | 345/46 |
| 2007/0242003 | A1 * | 10/2007 | Vogel et al. | 345/76 |
| 2007/0247414 | A1 * | 10/2007 | Roberts | 345/102 |
| 2008/0012507 | A1 * | 1/2008 | Nalbant | 315/306 |
| 2008/0055196 | A1 * | 3/2008 | Izumida | 345/46 |
| 2008/0303804 | A1 * | 12/2008 | Schmidt et al. | 345/204 |
| 2009/0009504 | A1 * | 1/2009 | Thiebaud et al. | 345/212 |

OTHER PUBLICATIONS

Bowling, Buck-Boost LED Driver Using the PIC16F785 MCU, Jul. 21, 2006. Available at http://ww1.microchip.com/ downloads/en/AppNotes/10147a.pdf>.
Unknown, "Hysteretic Boost-Buck (Cuk) LED Driver IC," available at http://www.supertex.com, 2007, 7 pages.
Unknown, "Designing a Boost-Buck (Cuk) Converter with the HV9930," available at http://www.supertex.com, 2005, 23 pages.

* cited by examiner

*Primary Examiner* — Nitin Patel
(74) *Attorney, Agent, or Firm* — Shaun P. Montana

(57) ABSTRACT

As apparatus for controlling operating parameters for a light emitting diode (LED). A driver receives an input voltage from a voltage source and a control signal. The driver provides a driver output current to the LED based on the control signal. The LED has an LED voltage as a function of the driver output current and has an LED power as a function of said LED voltage and said driver output current. A controller determines the LED voltage and produces the control signal provided to the driver as a function of the LED voltage. The control signal corresponds to a constant driver output current when the LED voltage is less than a predetermined voltage value. The control signal corresponds to a varying driver output current for substantially maintaining the LED power at a constant predetermined power value web the LED voltage is greater than the predetermined voltage value.

20 Claims, 8 Drawing Sheets

LIGHT EMITTING DIODE DRIVER PROVIDING CURRENT AND POWER CONTROL

BACKGROUND

This invention relates to solid-state light sources and particularly to light emitting diodes (LEDs). More particularly, the present invention relates to an apparatus for controlling power and current delivered to the LED.

Light emitting diodes (LEDs) are semiconductor devices that generate light when electrical energy (e.g., current, voltage) is applied to the device. A driver (i.e., one or more electronic components electrically connected to an LED) may be used for selectively applying electrical energy from an electrical energy source to the LED. A conventional LED driver has a particular topology for use with the electrical energy source to provide constant current to the LED. Thus, the LED driver allows the LED to continuously operate at a constant current level. The topology for the driver may be buck, boost, or a combination buck and boost (hereinafter referred to as "boost buck"), and is selected based on the electrical energy available from the electrical energy source and the electrical characteristics of the LED (e.g., forward voltage). For example, an LED driver having a boost buck topology must be used to drive an LED wherein the forward voltage of the LED may overlap the available source voltage.

Not all of the electrical energy applied to the LED is converted to light. A substantial portion of the applied electrical energy is dissipated in the form of heat by the LED. As the semiconductor material heats up, like most electronics devices, the LED performance is degraded. In particular, the power (e.g., heat) dissipated by the LED can cause decreased light output (flux), a color shift, and a reduction in device lifetime. To minimize the adverse effects of the power dissipation, various thermal management systems may be incorporated or used in conjunction with the LED.

For an LED driven from a driver having a constant current boost buck topology the power dissipation of the LED and hence the driver can vary, depending on the forward voltage of the LED. Conventionally, a thermal management system which assumes the worst case power dissipation is employed to avoid an excessive temperature rise resulting from the variable power dissipation of the LED. Referring to FIG. 1, for example, the driver may provide a constant current ($I_{led}$) to the LED until the forward voltage ($V_f$) of the LED reaches a maximum value ($V_{led\ max}$). When this condition is met, the driver shuts down or enters into a fail safe mode (i.e., ceases to apply current to the LED). However, this type of thermal management system fails to effectively solve the problem. In particular, the system can cause oversized heat sinks and/or require active cooling techniques.

FIG. 2 illustrates another technique for minimizing the adverse effects of variable power dissipation used for applications other than driving LEDs. As illustrated, the driver provides electrical energy to the load such that the load operates at a constant power and for a particular range of current and voltage values. Thus, the driver may provide current less than a maximum value ($I_{led\ max}$), as a function of the constant power value, until the voltage of the load reaches a maximum value ($V_{led\ max}$). When this condition is met, the driver shuts down or enters into a fail safe mode (i.e., ceases to apply current to the load). On the other hand, as the forward voltage decreases, to maintain a constant power level, the controller increases the operating current. Since the operating current needs to be limited to protect the LEDs, the driver needs to shut down upon reaching the maximum current, $I_{led\ max}$, which limits the operating region of the system

SUMMARY

Embodiments of the invention overcome one or more deficiencies of conventional practices related to maximizing LED performance by controlling power and current provided to the LED according to predetermined values. In particular, the present invention senses an operating parameter of the LED and provides either a constant power or a constant current to the LED based on the sensed operating parameter. As such the present invention advantageously minimizes the adverse effects of power dissipation.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Embodiments of the invention include an apparatus (hereinafter referred to as the "control system") for use with an electrical energy source for energizing a light source, such as a light emitting diode (LED). According to embodiments of the invention, the control system provides electrical energy to the light source as a function of a plurality of operating parameters (e.g., current, voltage, power) of the light source. In particular, the control system senses the operating parameters of the light source and operates in a first mode or a second mode based on one or more of the sensed operating parameters. In the first mode, the control system provides electrical energy to the light source to maintain (e.g., substantially maintain) a first operating parameter at a constant value. In the second mode, the control system provides electrical energy to the light source to maintain (e.g., substantially maintain) a second operating parameter at a constant value.

Figure 1:
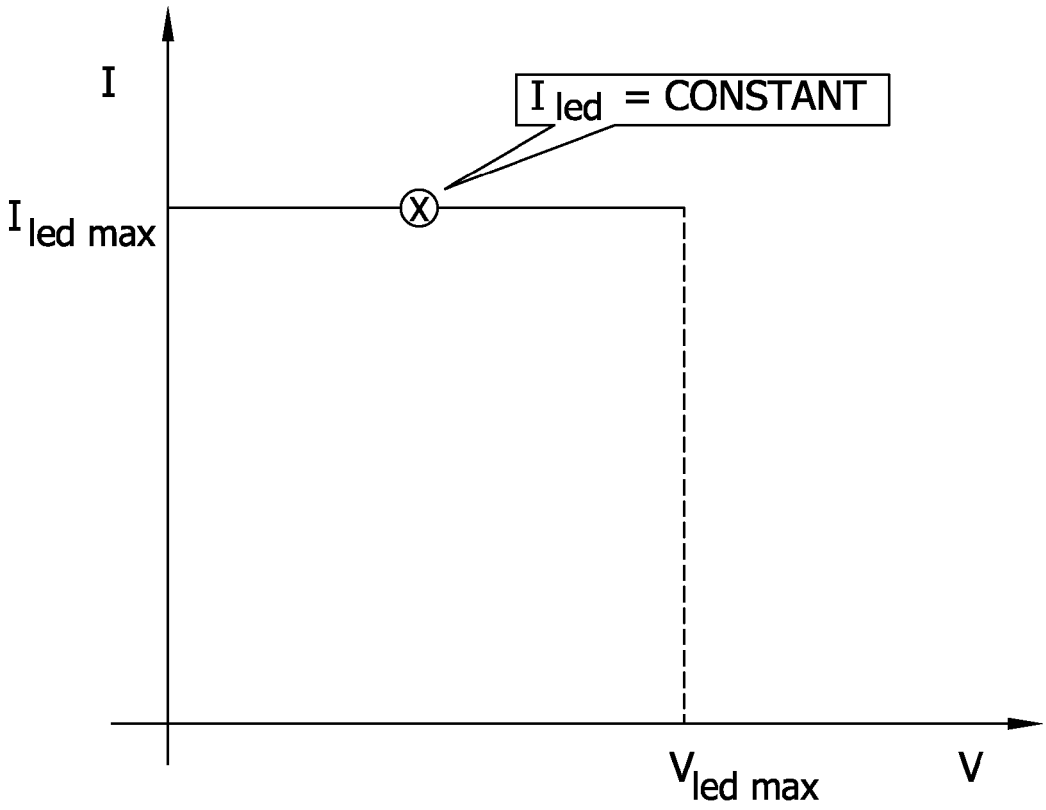
FIG. 1 is a graph illustrating a constant current operating path for an LED with current along the y axis and voltage along the x axis, according to related art.
Figure 2:
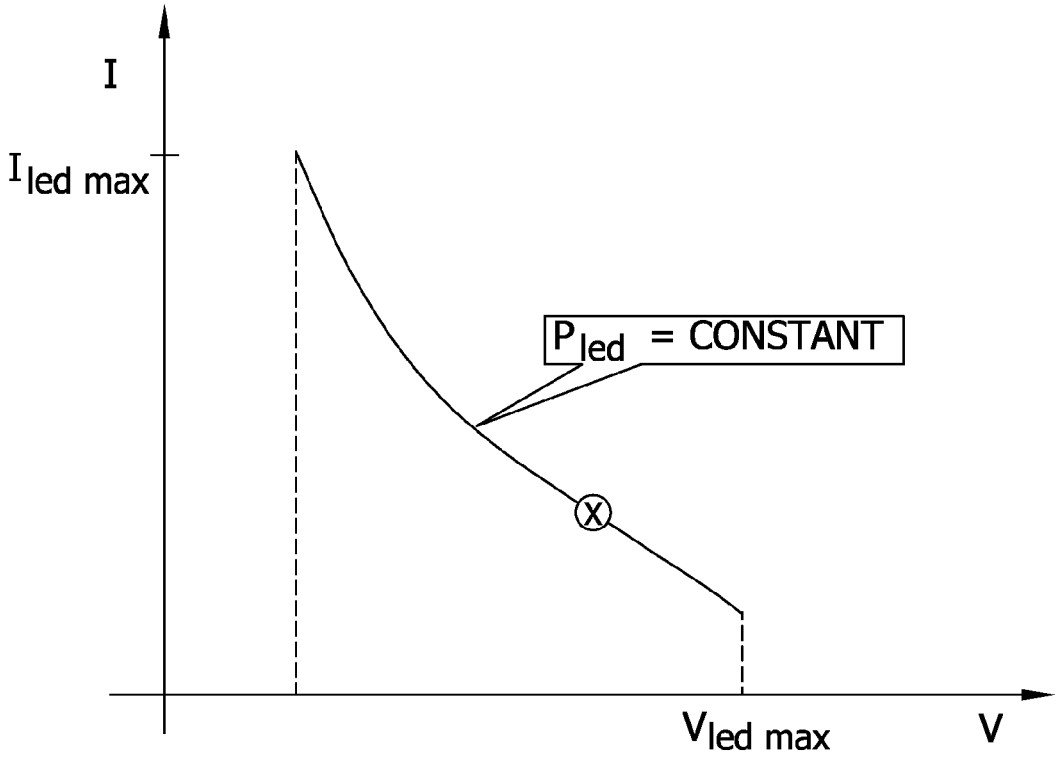
FIG. 2 is a graph illustrating a constant power operating path for an LED with current along the y axis and voltage along the x axis, according to related art.
Figure 3:
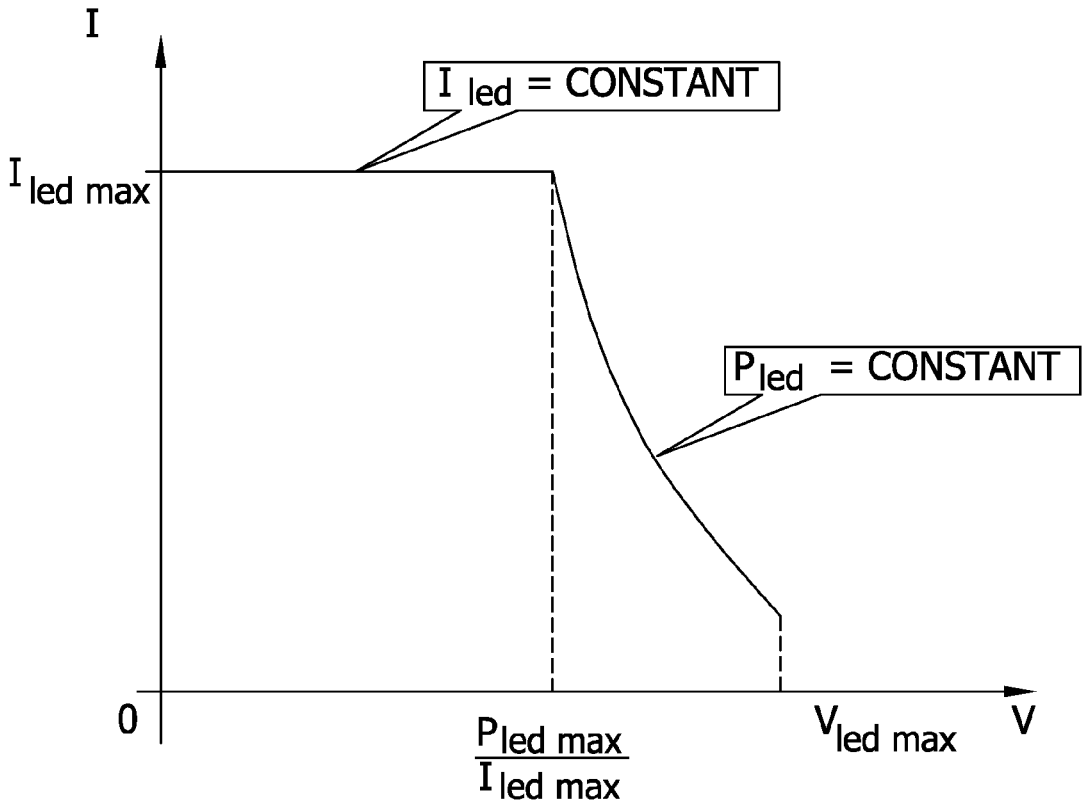
FIG. 3 is a graph illustrating an operating path for an LED with current along the y axis and voltage along the x axis, according to an embodiment of the present invention.
Figure 4:
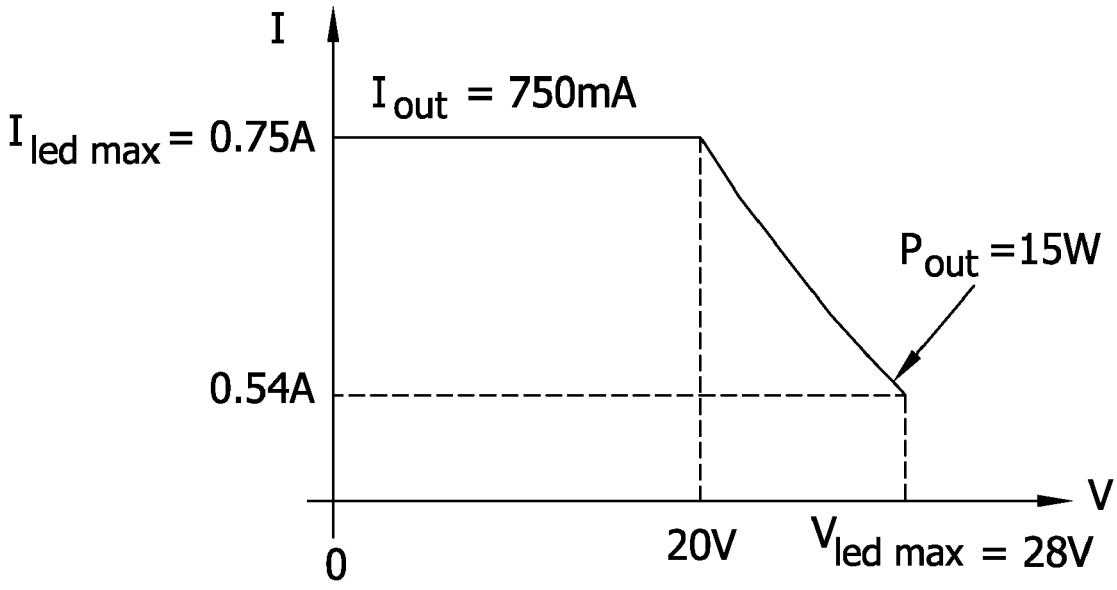
FIG. 4 is a graph illustrating an operating path with exemplary operating parameter values for an LED with current along the y axis and voltage along the x axis according to an embodiment of the present invention.

Referring to FIG. 3, in one embodiment of the present invention, the control system senses the voltage ($V_{led}$) of the light source. The control system operates in a first mode and a second mode as a function of the sensed voltage ($V_{led}$). For example, as illustrated by FIG. 3, the system may operate in the first mode when the sensed voltage ($V_{led}$) is less than (i.e., not greater than) a predetermined voltage value and may operate the second mode when the sensed voltage ($V_{led}$) is greater than the predetermined voltage value. In the first mode, the control system provides electrical energy to the light source to maintain the current ($I_{led}$) of the light source at a constant value ($C_I$). In the second mode, the control system provides electrical energy to the light source to maintain the power ($P_{led}$) of the light source at a constant value ($C_P$). FIG. 4 illustrates a specific operating path and operating parameter values for an exemplary embodiment of the present invention.

Figure 5:
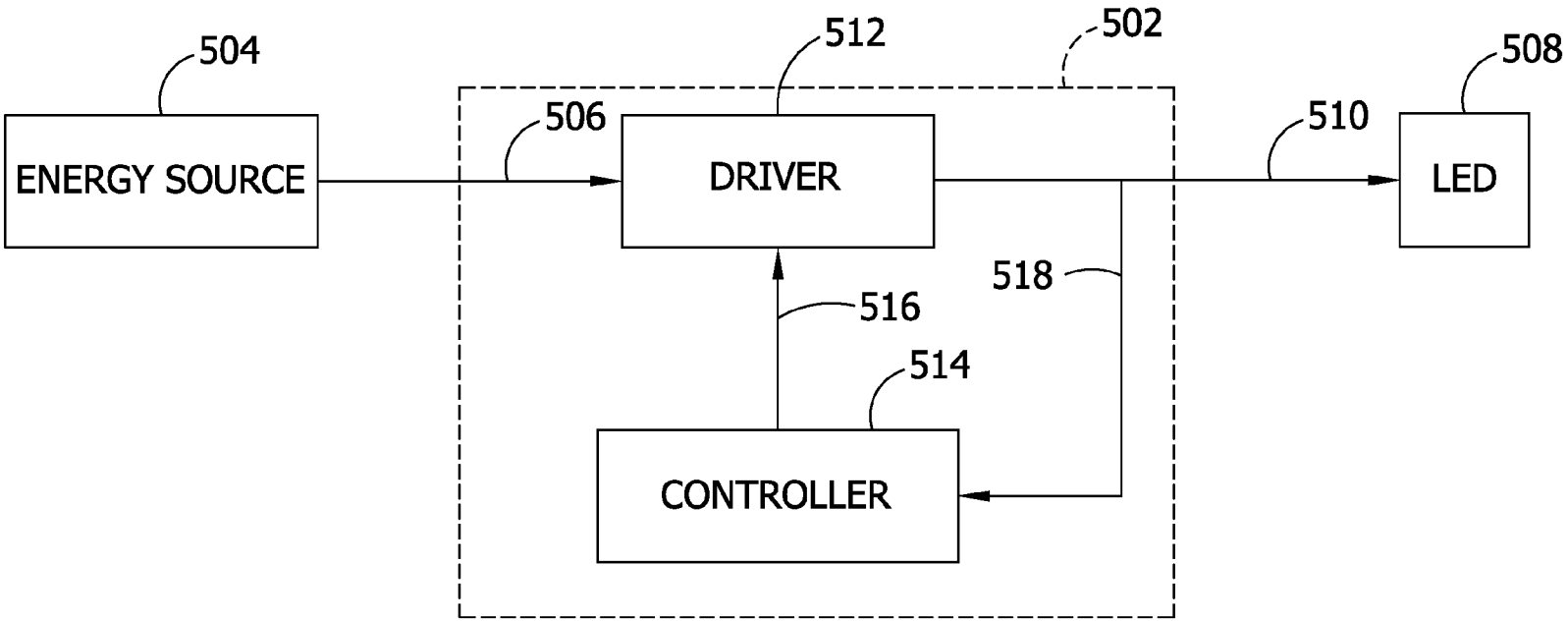
FIG. 5 is a block diagram illustrating an apparatus for use with an electrical energy source for energizing a light emitting diode according to an embodiment of the invention.

Referring to FIG. 5, in one embodiment of the present invention, the control system 502 is electrically connected to the electrical energy source 504 for receiving electrical energy from the energy source as an input signal 506. The electrical energy source 504 may comprise a current source and/or a voltage source. Correspondingly, the input signal 506 may comprise a current signal and/or a voltage signal. The control system 502 is also electrically connected to the light emitting diode (LED) 508 for energizing the LED 508, via an output signal 510, as a function of the input signal 506. The LED 508 may comprise one or more of the following: a light emitting diode, an ultra-violet (UV) emitting LED, an infrared (IR) emitting diode, and a laser diode.

The control system 502 of the illustrated embodiment includes a driver 512 and a controller 514 (e.g., microcontroller, programmable logic device, processor, microprocessor, computing device) in electrical communication with each other. The driver 512 receives the input signal 506 from the electrical energy source 504 and a control signal 516 from the controller 514. The driver 512, having a particular topology, converts the input signal 506 and provides the converted input signal (i.e., the output signal 510) to the LED 508 based on the control signal 516. In an embodiment, the driver 512 receives information to vary the LED current from control signal 516. The output signal defines the operating parameters (e.g., current, voltage, power) associated with the LED. In particular, the output signal provides the LED with a current and a voltage (i.e., $I_{led}$ and $V_{led}$). As known in the art, the current and voltage have a dependent functional relationship. Additionally, the output signal provides the LED with a power (i.e. $P_{led}$). As known in the art, the power is functionally dependent on the current and voltage. The controller 514 produces the control signal 516. In particular, the controller 514 receives a feedback signal 518 representing the operating parameter, $V_{led}$ of the LED and produces the control signal 516 provided to the driver as a function of the received operating parameter value.

Figure 6:
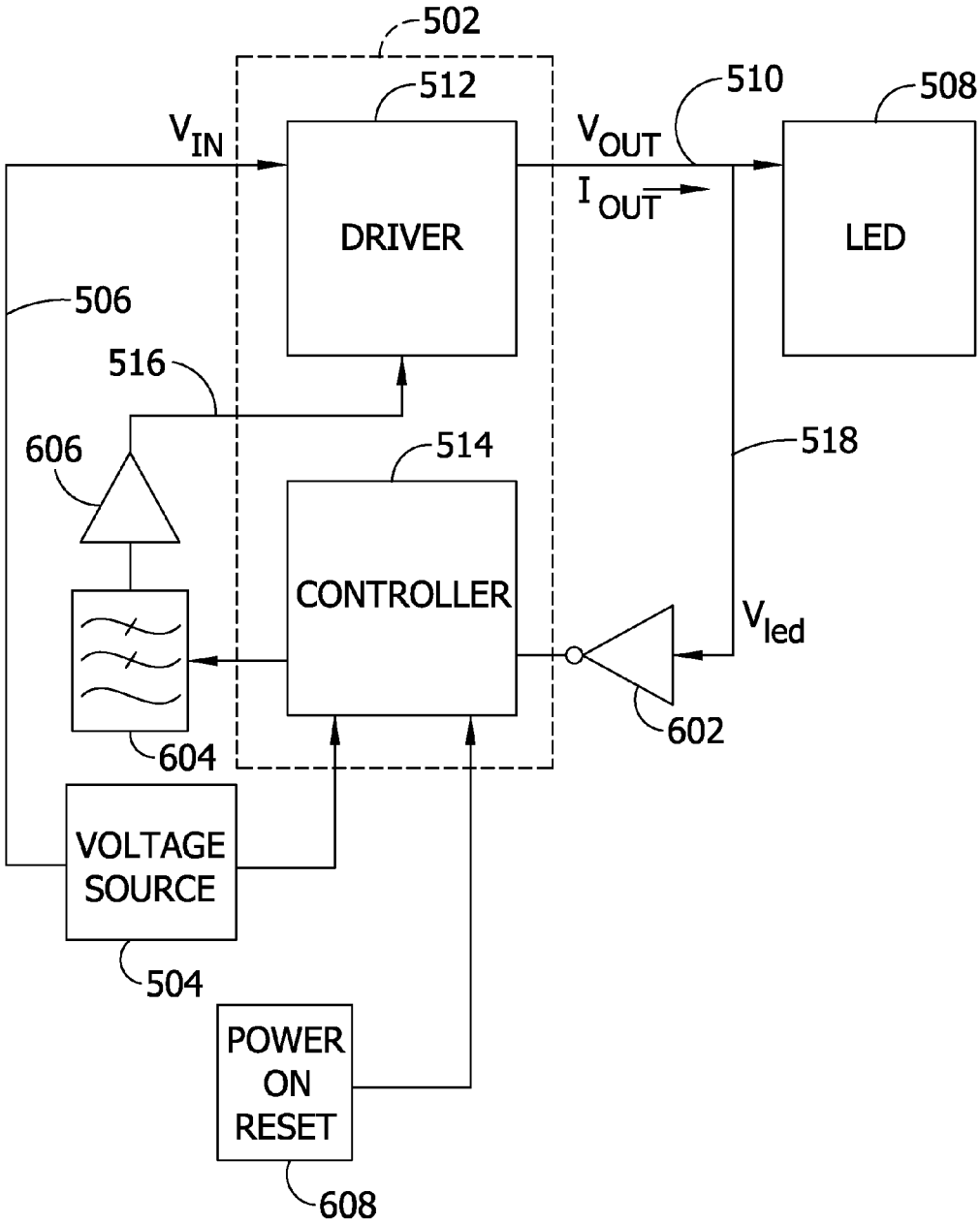
FIG. 6 is a block diagram illustrating an apparatus for use with a voltage source for energizing a light emitting diode according to an embodiment of the invention.

Referring to FIG. 6, in an embodiment of the invention, the control system 502 is used with a voltage source 504 for energizing the LED 508. The driver 512 comprises a voltage controlled current source (VCCS). Accordingly, the driver 512 receives a driver input voltage ($V_{in}$) 506 from the voltage source 504 and a control signal 516 from the controller 514 and provides a driver output current ($I_{led}$) to the LED 508 based on the control signal 516. The LED 508 receives the driver output current ($I_{led}$) and has a voltage ($V_{led}$) as a function of the driver output current ($I_{led}$) and a power ($P_{led}$) as a function of the voltage ($V_{led}$) and the driver output current ($I_{led}$). The controller 514 determines the LED 508 current ($I_{led}$). In an embodiment, the control system 502 may further include various electrical components, such as an inverting amplifier 602 and/or an analog to digital converter (not illustrated), for determining the LED voltage ($V_{led}$). The controller 514 produces the control signal 516 as a function of the LED voltage ($V_{led}$). The controller 514 is configured such that the control signal 516 corresponds to a constant output current when the LED voltage ($V_{led}$) is less than a predetermined voltage value and to a varying driver output current for substantially maintaining the LED power at a constant predetermined power value (i.e. $P_{led}$=constant) when the LED 508 voltage is greater than the predetermined voltage. The controller 514 transmits the control signal (e.g., a voltage signal or a current signal) 516 to the driver 512. In an embodiment, the control system 502 may further include various electrical components such as a low pass filter 604 and an amplifier 606 for transmitting the control signal 516 to the driver 512. In an embodiment, the control system 502 further includes a reset component 608 for resetting the control system 502.

Figure 7:
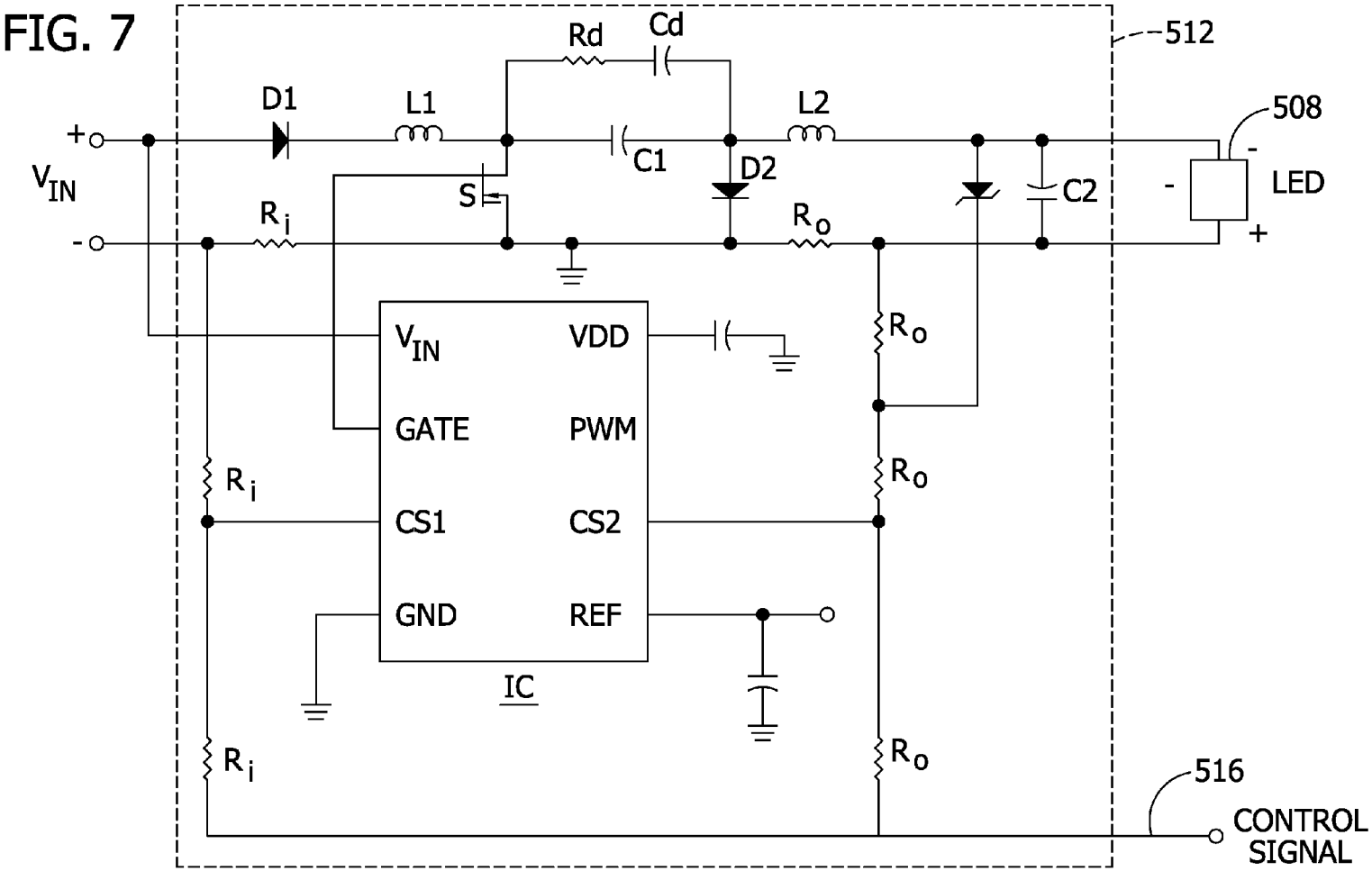
FIG. 7 is a circuit diagram illustrating electrical components of a driver according to an embodiment of the invention.

Referring to FIG. 7, in an embodiment of the invention the driver 512 has a boost buck topology. Accordingly, the driver 512 includes a switching component S having a switching frequency for adjusting the driver 512 output current. For example, the driver 512 may include a switching transistor S having a duty cycle which is adjusted to provide the driver 512 output current to the LED 508 according to the control signal. In an embodiment of the invention, the driver 512 may further include an integrated circuit (IC) for receiving the output driver current ($I_{led}$) and the control signal 516 and controlling/adjusting the driver output signal ($I_{led}$) based on said received signals. FIG. 7 illustrates an exemplary driver 512 comprising a variable frequency pulse width modulation controller integrated circuit IC and having a boost buck topology (e.g., HV9930 hysteric boost-buck LED driver IC) according to an embodiment of the invention. Briefly described, the illustrated exemplary driver 512 includes electrical components $L_1$, S, $C_1$, $L_2$, $D_2$, and $C_2$ for performing boost buck functions. The illustrated exemplary driver 512 includes electrical components $R_d$ and $C_d$ for performing damping functions. The illustrated exemplary driver 512 includes a diode $D_1$ for preventing electrical discharge from $C_d$ and $C_1$ when switch S is open. The illustrated exemplary driver 512 includes resistors $R_1$ for sensing a driver input current and includes resistors Ro for sensing a driver output current ($I_{led}$). The illustrated exemplary driver 512 includes the IC for receiving the sensed driver input current, the sensed driver output current ($I_{led}$), and the control signal 516 and adjusting the duty cycle of the switch S based on said received signals.

In an embodiment of the invention, the controller 514 includes a storage medium for storing data for defining the control signal 516 provided to the driver 512 as a function of the LED 508 operating parameters. For example, the storage medium may store a maximum power value, a maximum voltage value, and/or a maximum current value. Additionally, the storage medium may include a mapping component for mapping the LED voltage value ($V_{led}$) received by the controller 514 to values of the driver output current corresponding to a constant driver output current signal (e.g., the maximum current value) or a constant LED power (e.g., the maximum power value). The storage media may be internal or external to the controller 514. Exemplary internal storage media include RAM, ROM, EEPROM, flash memory and/or other internal storage media known in the art. Exemplary external storage media include memory sticks, CD-ROM, digital versatile disks (DVD), magnetic cassettes, magnetic tape, magnetic disks and/or other storage media known in the art.

Figure 8:
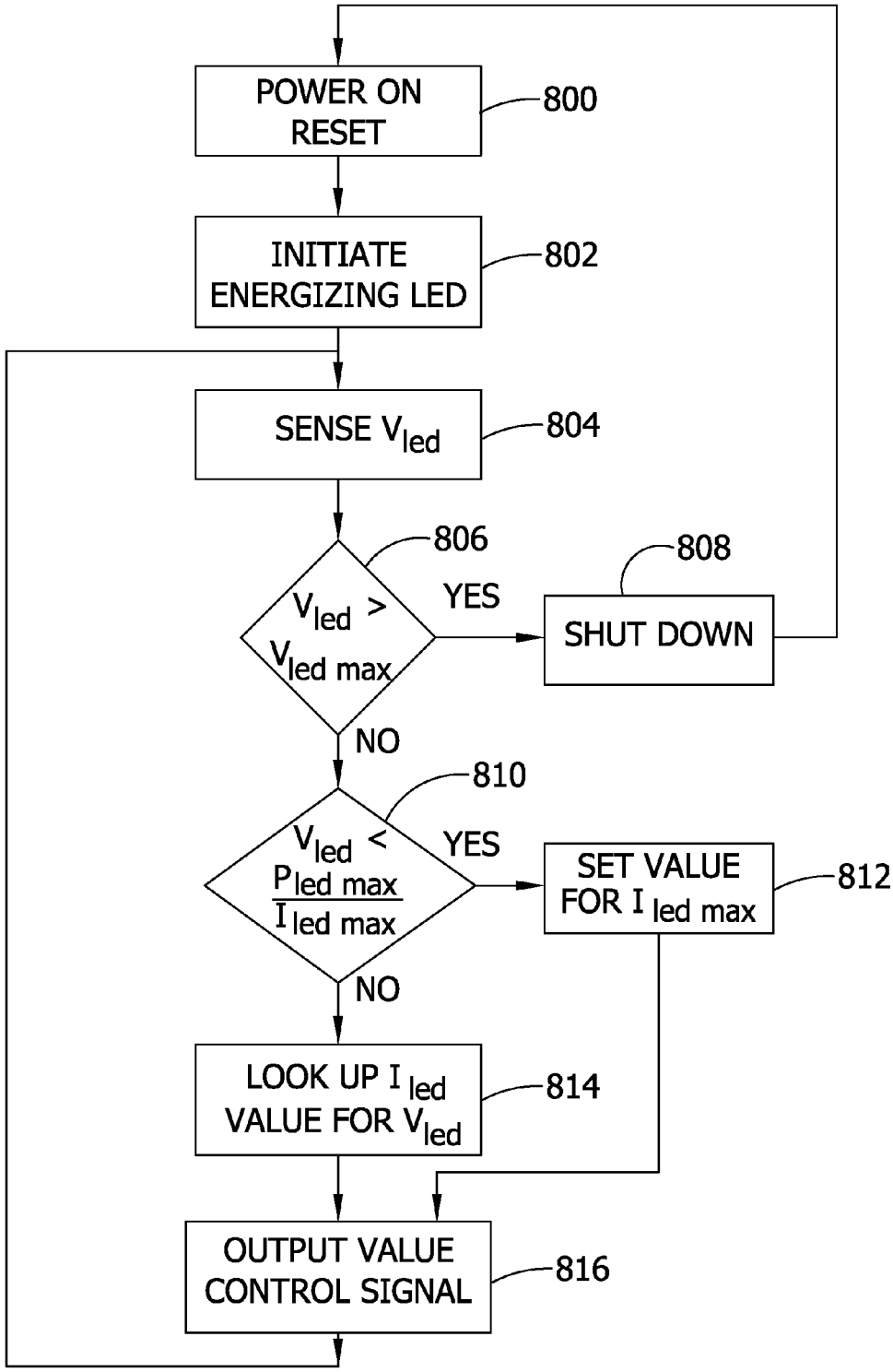
FIG. 8 is a flow diagram illustrating operations performed by a controller according to an embodiment of the invention.

FIG. 8 is a flow diagram illustrating the configuration of the controller 514 according to an embodiment of the present invention. In response to receiving a reset signal, at 800, the controller 514 resets the controller 514 and/or driver 512 components. At 802, the controller 514 produces a control signal to the driver 512 to initiate energizing the LED 508 (i.e., providing the driver 512 output current to the LED 508). At 804, the controller 514 senses the LED voltage($V_{led}$). At 806, the controller 514 is configured to compare the LED voltage ($V_{led}$) to a predetermined value (e.g., value stored in the storage medium). In particular, the controller 514 is configured to determine whether the LED voltage ($V_{led}$) is greater than a maximum voltage value ($V_{led\ max}$). If the controller 514 determines that the LED voltage ($V_{led}$) is greater than the maximum voltage value ($V_{led\ max}$), the controller 514 is configured to operate in a shut down mode at 808. In the shut down mode, the controller 514, responsive to receiving a power on reset signal, resumes normal operation as discussed above at 800. If the controller 514 determines the LED voltage ($V_{led}$) is less than the maximum voltage value ($V_{ledmax}$) the controller 514 compares at 810 the LED voltage ($V_{led}$) to a predetermined value (e.g., value stored in the storage medium). In particular, the controller 514 is configured to determine whether the LED voltage value ($V_{led}$) is less than a maximum power value divided by a maximum current value ($P_{led\ max}/I_{ledmax}$). If the controller 514 determines that the LED voltage ($V_{led}$) value is less than the maximum power value divided by the maximum current value ($P_{led\ max}/I_{led\text{-}max}$), the controller 514 is configured to operate in a first operating mode. In the first operating mode the controller 514 sets the control signal value to correspond to the maximum current value ($I_{ledmax}$) at 812, transmits the control signal value at 816 and senses the LED voltage ($V_{led}$) as previously discussed above at 804. Thus, in the first operating mode the controller 514 controls the driver 512 to provide a substantially constant driver output current ($I_{led}$) to the LED 508. If the controller 514 determines that the LED voltage value ($V_{led}$) is not less than the maximum power value divided by the maximum current value ($P_{led\ max}/I_{ledmax}$), the controller 514 is configured to operate in a second operating mode. In the second operating mode, the controller 514 at 814 determines a value for the driver current as a function of the LED voltage value ($V_{led}$). For example, the controller 514 may reference a look up table or an equation (e.g., $P_{led\ max}/V_{led}$) to determine the value for the driver output current ($I_{led}$) for operating the LED at the maximum power value ($P_{led\ max}$). The controller 514 transmits the control signal value 516 having a value corresponding to the determined driver output current value ($I_{led}$) at 816, and senses the LED voltage ($V_{led}$) as previously discussed above at 804. Thus, in the second operating mode, the controller 514 controls the driver 512 to vary the driver output current ($I_{led}$) to the LED 508 according a constant power value.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Embodiments of the invention may be implemented with computer-executable instructions. The computer-executable instructions may be organized into one or more computer-executable components or modules. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. An apparatus used with a voltage source for energizing a light emitting diode (LED), said apparatus comprising:

a driver receiving an input voltage from the voltage source and a control signal and providing a driver output current to the LED based on the control signal, said driver having a boost buck topology, said LED having an LED voltage as a function of said driver output current and having an LED power as a function of said LED voltage and said driver output current; and a controller determining the LED voltage and producing the control signal provided to the driver as a function of the LED voltage, said control signal corresponding to a constant driver output current when the LED voltage is less than a predetermined voltage value, said control signal corresponding to a varying driver output current for substantially maintaining the LED power at a constant predetermined power value when the LED voltage is greater than the predetermined voltage value.

2. The apparatus of claim 1 wherein the driver comprises a voltage controlled current source.

3. The apparatus of claim 1 wherein the driver comprises a switching component having a switching frequency for providing the driver output current to the LED based on the control signal.

4. The apparatus of claim 1 wherein the driver receives the driver output current and provides the driver output current to the LED based on the control signal and the driver output current.

5. The apparatus of claim 1 wherein the controller comprises storage medium for storing data for defining the control signal provided to the driver as a function of the LED voltage, said stored data comprising values for the LED voltage mapped to values of the driver output current.

6. The apparatus of claim 1 wherein the constant driver output current has a maximum current value and the predetermined power value is a maximum power value and wherein the predetermined voltage value is the maximum power value divided by the maximum current value.

7. The apparatus of claim 1 wherein the control signal is a voltage signal.

8. An apparatus used with a voltage source for controlling an input parameter for a light emitting diode (LED), said apparatus comprising:

a driver receiving an input voltage from the voltage source and providing a driver output current to the LED, said driver having a boost buck topology, said LED having an LED voltage as a function of said driver output current and having an LED power as a function of said LED voltage and said driver output current; and a controller for receiving the LED voltage and operating in a first mode and a second mode as a function of said LED voltage, said first mode controlling the driver to provide a substantially constant driver output current to the LED, said second mode controlling the driver to vary the driver output current to the LED according to a constant power value.

9. The apparatus of claim 8 further comprising the LED.

10. The apparatus of claim 8 wherein the controller operates in a first mode, a second mode, and a third mode as a function of said voltage, said first mode controlling the driver to provide a substantially constant driver output current to the LED, said second mode controlling the driver to vary the driver output current to the LED according to a constant power value, said third mode controlling the driver cease providing a driver output current to the LED.

11. The apparatus of claim 8 further comprising a means for electrical communication from the controller to the driver, said controller controlling said driver via said means for electrical communication.

12. The apparatus of claim 8 wherein the driver comprises a switching component having a switching frequency for providing the driver output current to the LED based on the control signal.

13. The apparatus of claim 8 wherein the driver receives the driver output current and subsequently provides the driver output current to the LED based on the control signal and the driver output current.

14. The apparatus of claim 8 wherein the controller comprises a storage medium for storing data for defining the control signal provided to the driver as a function of the LED voltage, said stored data comprising values for the LED voltage mapped to values of the driver output current.

15. The apparatus of claim 8 wherein the controller operates in a first mode when said LED voltage is greater than a predetermined voltage value and said controller operates in a second mode when said LED voltage is less than the predetermined voltage value.

16. The apparatus of claim 15 wherein the driver output current is a maximum current value and the constant power value is a maximum power value and wherein the predetermined voltage value is the maximum power value divided by the maximum current value.

17. A method for controlling an electrical energy parameter provided to a light emitting diode (LED), said method comprising:

sensing by a driver a first electrical energy parameter of the LED;

sensing by a controller a second electrical energy parameter of the LED, said LED having an LED power as a function of the first electrical energy parameter and said second electrical energy parameter;

determining by the controller whether the second electrical energy parameter is greater than a predetermined value;

generating by the controller a control signal based on said determining, said control signal specifying a value for the first electrical parameter to maintain the first electrical energy parameter as constant when the second electrical energy parameter is not greater than the predetermined reference electrical energy value, said control signal specifying a value for the first electrical parameter to maintain the LED power as constant when the second electrical energy parameter is greater than the predetermined reference electrical energy value; and controlling by the driver the first electrical energy parameter provided to the LED based on the first electrical energy parameter and the control signal generated by the controller.

18. The method of claim 17 wherein the first electrical energy parameter is current.

19. The method of claim 18 wherein the second electrical energy parameter is voltage.

20. An apparatus used with a voltage source, said apparatus comprising:

a light emitting diode (LED);

a driver receiving an input voltage from the voltage source and a control signal and providing a driver output current to the LED based on the control signal, said driver having a boost buck topology, said LED having an LED voltage as a function of said driver output current and having an LED power as a function of said LED voltage and said driver output current; and a controller for receiving the LED voltage and producing the control signal provided to the driver as a function of the LED voltage, said control signal representative of constant values for the driver output current when the LED voltage is less than a predetermined voltage value, said control signal representative of values for the driver output current varying to substantially maintain the LED power at a constant predetermined power value wherein the LED voltage is greater than the predetermined voltage value.

* * * * *